US006919522B2

(12) United States Patent
Uehira

(10) Patent No.: US 6,919,522 B2
(45) Date of Patent: Jul. 19, 2005

(54) INPUT DEVICE

(75) Inventor: Kiyotaka Uehira, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/500,534

(22) PCT Filed: Dec. 5, 2003

(86) PCT No.: PCT/JP03/15606

§ 371 (c)(1),
(2), (4) Date: Jun. 30, 2004

(87) PCT Pub. No.: WO2004/055846

PCT Pub. Date: Jul. 1, 2004

(65) Prior Publication Data

US 2005/0034965 A1 Feb. 17, 2005

(30) Foreign Application Priority Data

Dec. 17, 2002 (JP) ..... 2002-364850

(51) Int. Cl.[7] ..... H01H 13/14
(52) U.S. Cl. ..... 200/341; 200/334
(58) Field of Search ..... 200/341–345, 200/331, 334, 510–520, 17 R, 43.18, 33 D, 47

(56) References Cited

U.S. PATENT DOCUMENTS 5,808,532 A 9/1998 DiVincenzo et al.
6,124,709 A * 9/2000 Allwine ..... 324/207.2
6,420,843 B1 * 7/2002 Pohl ..... 318/266
6,710,565 B2 * 3/2004 Maeda ..... 200/501

FOREIGN PATENT DOCUMENTS

| | | |
|---|---|---|
| EP | 0 883 150 A | 12/1998 |
| JP | 63-165723 | 10/1988 |
| JP | 01-092026 | 6/1989 |
| JP | 02-037627 A | 2/1990 |
| JP | 2001-297652 | 10/2001 |

OTHER PUBLICATIONS

European Search Report corresponding to application No. EP 03–77–7296 dated Jan. 31, 2005.

Japanese International Search Report for application No. PCT/JP2003/015606, dated Feb. 17, 2004.

* cited by examiner

*Primary Examiner*—Lincoln Donovan
*Assistant Examiner*—M. Fishman
(74) *Attorney, Agent, or Firm*—RatnerPrestia

(57) ABSTRACT

An input device includes a button, a case operable to guide the button for allowing the button to slide, a switch fixed to the case and activated with the button, a motor fixed to the case, a driving member fixed to one of the button and the motor, a coil spring fixed to other of the button and the motor. The coil spring is operable to be engaged with the driving member. The coil spring is operable to be rotated to move relatively to the driving member. Since the button is linked to the motor with the coil spring, the button moves in up and down directions, and the input device has a simple mechanism operable to activate the switch.

11 Claims, 11 Drawing Sheets

INPUT DEVICE

This Application is U.S. National Phase Application of PCT International Application PCT/JP2003/015606.

TECHNICAL FIELD

This invention relates to an input device including a button capable of projecting by an amount controllable arbitrarily.

BACKGROUND ART

FIG. 10 is a cross-sectional view of an input device including a button 21 movable in up and down used an information device for visually-challenged persons, and disclosed in Japanese Patent Laid-Open Publication No. 2001-7652. Button 21 moves upward and downward acording to up and down movement of up/down pin 25 which is moved by rotating ascend/descend gear 24 engaged with pinion 23 of motor 22. More specifically, screw portion 26 of up/down pin 25 is rotatably engaged to a central screw hole of ascend/descend gear 24. When ascend/descend gear 24 rotates, up/down pin 25 shifts in up and down directions by an interactive force caused by the screw hole of ascend/descend gear 24 and the screw portion cut on up/down pin 25, hence moving button 21. Pinion 23 of motor 22 is movable in right and left directions. Pinion 23 can be engaged with ascend/descend gear 24 and can be separated releasing the engaging. Switch 27 is activated with button 21.

In this conventional input device, since up/down pin 25 is engaged with ascend/descend gear 24 to be linked to gear 24, ascend/descend gear 24 and up/down pin 25 move together when button 21 is manually pressed. Therefore, immobile motor 22 and pinion 23 linked together serve as a resistive force against up and down movement of button 21 after motor 22 moves button 21 through pinion 23, affecting operability of button 21. In order to avoid it, a mechanism for releasing pinion 23 from ascend/descend gear 24 is necessary. A mechanism for moving pinion 23 in right and left directions to release the gears from each other has the input device be large and complicated.

SUMMARY OF THE INVENTION

An input device includes a button, a case operable to guide the button for allowing the button to slide, a switch fixed to the case and activated with the button, a motor fixed to the case, a driving member fixed to one of the button and the motor, a coil spring fixed to other of the button and the motor. The coil spring is operable to be engaged with the driving member. The coil spring is operable to be rotated to move relatively to the driving member.

Since the button is linked to the motor with the coil spring, the button moves in up and down directions, and the input device has a simple mechanism operable to to activate the switch.

DETAILED DESCRIPTION OF PREFERRED EMBODIMENTS

Exemplary Embodiment 1

Figure 1A:
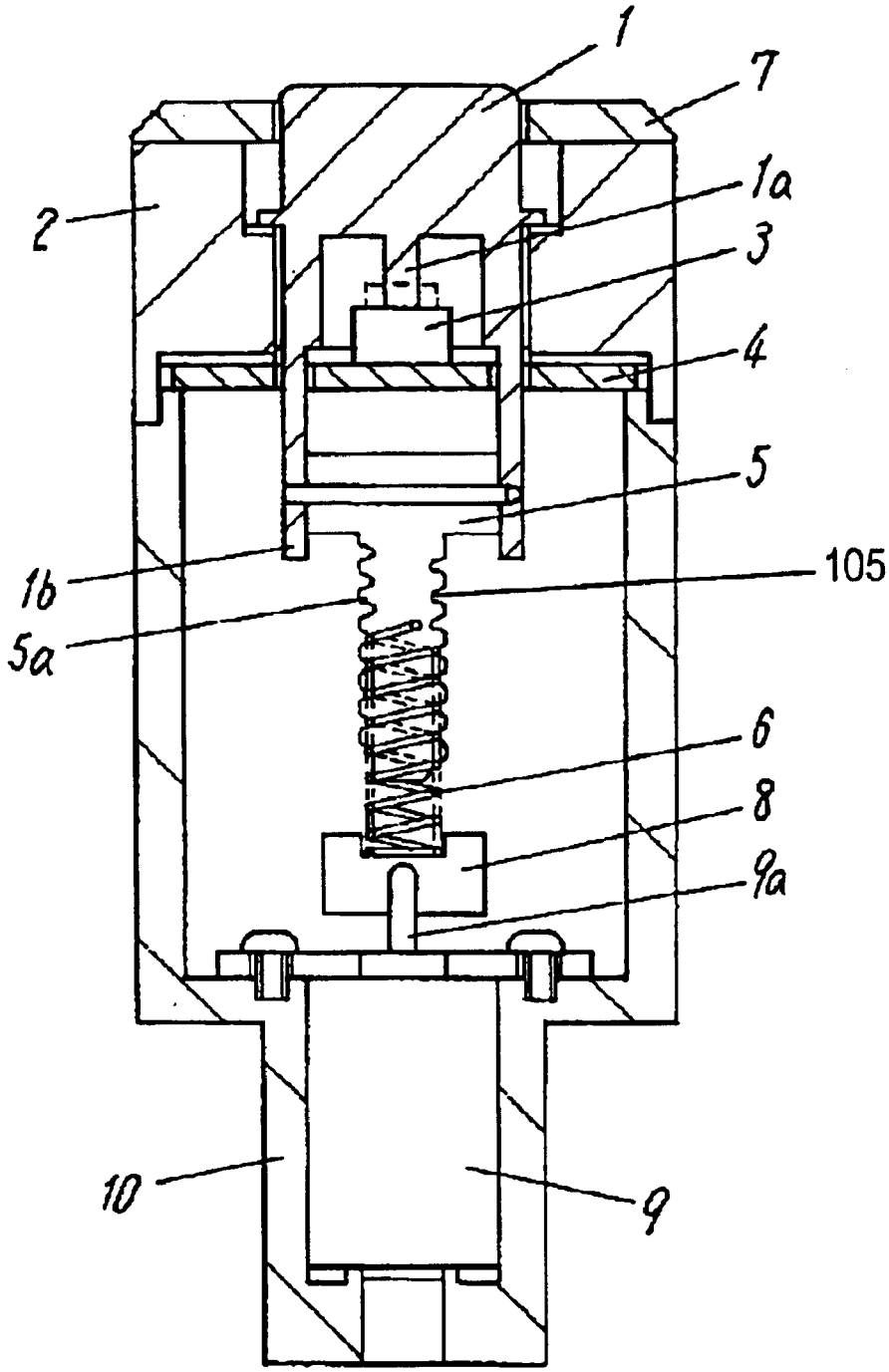
FIG. 1A is a cross-sectional view of an input device in accordance with Exemplary Embodiment 1 of the present invention.
Figure 1B:
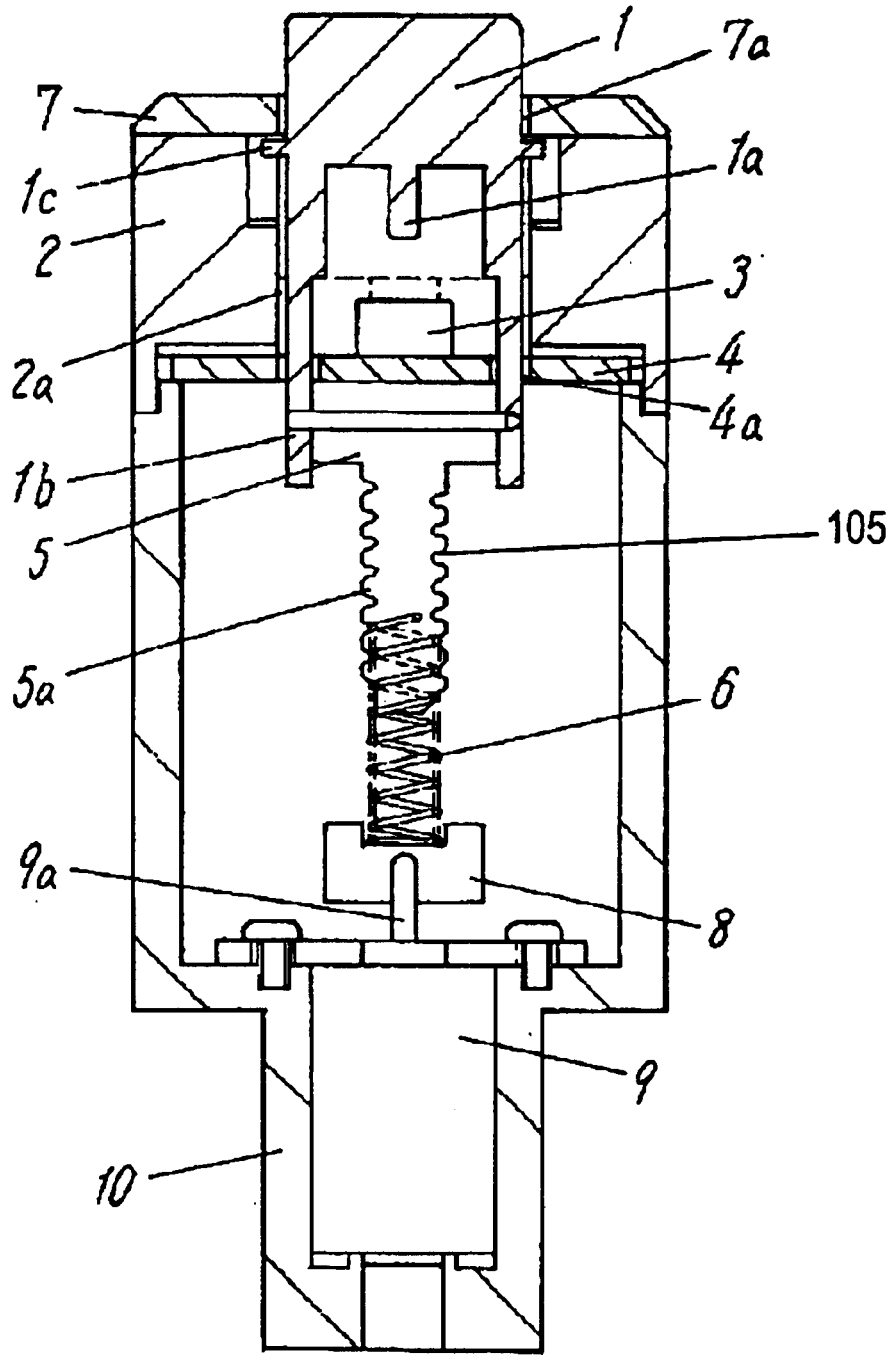
FIG. 1B is a cross-sectional view of the input device in accordance with Embodiment 1.

FIGS. 1A and 1B are cross-sectional views of an input device in accordance with Exemplary Embodiment 1 of the present invention. Rotation of button 1 is restricted by through-hole 2*a* provided in case 2, and the button is guided to slide only in up and down directions in the through-hole. Button 1 has protrusion 1*a* at its bottom. Push switch 3 is placed on a position of printed board 4 facing protrusion 1*a*. Button 1 has legs 1*b* at its lower part. Legs 1*b* extend downward through through-hole 4*a* provided in printed board 4, and are fixed to driving member 5. Driving member 5 has helical part 5*a* having recess 105 formed therein in a spiral shape of a predetermined pitch. Helical part 5*a* is engaged with coil spring 6 having a pitch identical to the pitch of the recess. Button 1 is always pushed up by coil spring 6 with its resilient force. Button 1 has brim 1*c* on its side surface. Button 1 moves in through-hole 7*a* of lid 7 fixed on an upper surface of case 2. Upward movement of button 1 is limited with brim 1*c* stopped by a lower surface of cover 7. Coil spring 6 is fixed to fixing-component 8. Fixing-component 8 is fixed to output shaft 9*a* of motor 9. Motor 9 is fixed to base 10. Base 10 and case 2 provides a case accommodating aforementioned elements.

An operation of the input device will be explained.

FIG. 1B shows an input device at an ordinary state, in which button 1 projects from an upper surface of cover 7. Upon being pressed down, button 1 moves down along through-hole 2*a* of case 2 against an upward resiliency of coil spring 6, and then, pushes down switch 3 with protrusion 1*a* formed at the bottom of the button. Thus, switch 3 can operate ordinarily, that is, can turn on and off.

When motor 9 is energized to rotate coil spring 6 via fixing component 8, coil spring 6 is engaged onto helical part 5*a* of driving member 5, namely coil spring 6 moves relatively against driving member 5. According to this movement, button 1 fixed to driving member 5 shifts and slides downward while being restricted in its rotational movement by through-hole 2*a* of case 2, and then, button 1 is sunk in through-hole 7*a* of cover 7. The input device in this situation is shown in FIG. 1A. As shown in FIG. 1A, button 1 moves down to turn on the switch. The device may include another mechanism (not shown) to allow button 1 to turn off the switch when the button moves down.

In order to have button 1 project as shown in FIG. 1B, motor 9 rotates reversely to have the device execute an reverse operation, hence easily allowing the device shown in FIG. 1A to return to the device shown in FIG. 1B easily.

As described, the input device according to Embodiment 1 includes a simple structure having spring 6 which allows button 1 to move in up and down directions and allows switch 3 to be turned on and off without a complicated mechanism, such as wheels, belts, and cams.

Moving speed of button 1 is adjustable by controlling a rotational speed of motor 9, hence preventing a colliding sound of button 1 which is likely to occur, for example, when button 1 is abruptly moved by a solenoid. While button 1 moves down, button 1 is prevented from automatically returning to the status in FIG. 1B even when button 1 receives outside disturbing factors, such as vibration and impact, because button 1 is linked to motor 9 through coil spring 6.

A length of a portion effective for expansion and contraction of coil spring 6 may be adjusted, and pressing force of button 1 for activating switch 3 can be accordingly controlled arbitrarily In order to slide smoothly, coil spring 6 employ a wire processed to have a friction-reducing surface. The surface reduces a friction caused by coil spring 6 when the spring slides on helical part 5*a* of driving member 5, hence enabling the spring to be wound smoothly around the helical part. Since frictional wear of coil spring 6 and driving member 5 is reduced, coil spring 6 and driving member 5 have long life. Helical part 5*a* of driving member 5 may be processed to have a reduced-friction surface, and driving member may be processed to have a material having a superior sliding characteristic thereon, hence providing similar effect.

Exemplary Embodiment 2

Figure 2:
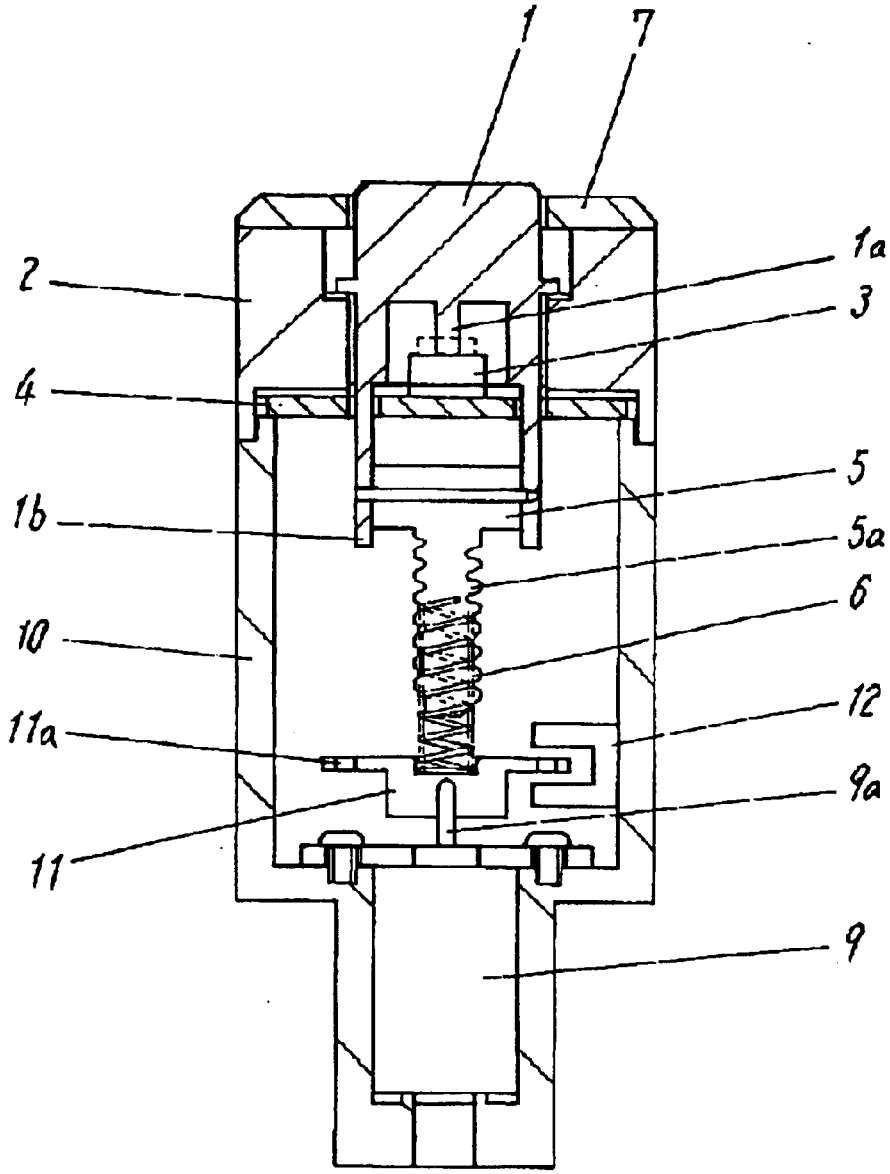
FIG. 2 is a cross-sectional view of an input device in accordance with Exemplary Embodiment 2 of the invention.

FIG. 2 is a cross-sectional view of an input device in accordance with Exemplary Embodiment 2 of the present invention. In FIG. 2, the same elements as those shown in FIG. 1 according to Embodiment 1 are denoted by the same reference numerals, are not described. Plural slits 11*a* are formed along a circumference of rotation disk 11 fixed to output shaft 9*a* of motor 9. Photo coupler 12 provided on base 10 surrounds slits 11*a*. Coil spring 6 is fixed to rotation disk 11. When motor 9 rotates, slits 11*a* of rotating disk 11 open and close an optical path of photo coupler 12. The photo coupler detects the opening and closing of the path, hence detecting a rotational amount of coil spring 6, i.e., a moving amount of button 1 in up and down directions. Namely, rotation disk 11 and photo coupler 12 function as an optical encoder detecting rotation of motor 9. Since the position of moving button 1 in up and down directions is detected and arbitrarily controlled, a projecting amount of button 1 can be controlled.

According to Embodiment 2, another type of encoder, such as a magnetic type, an electromagnetic type, or a resistor type may be used instead of the optical encoder including photo coupler 12, and providing similar effects.

Exemplary Embodiment 3

Figure 3:
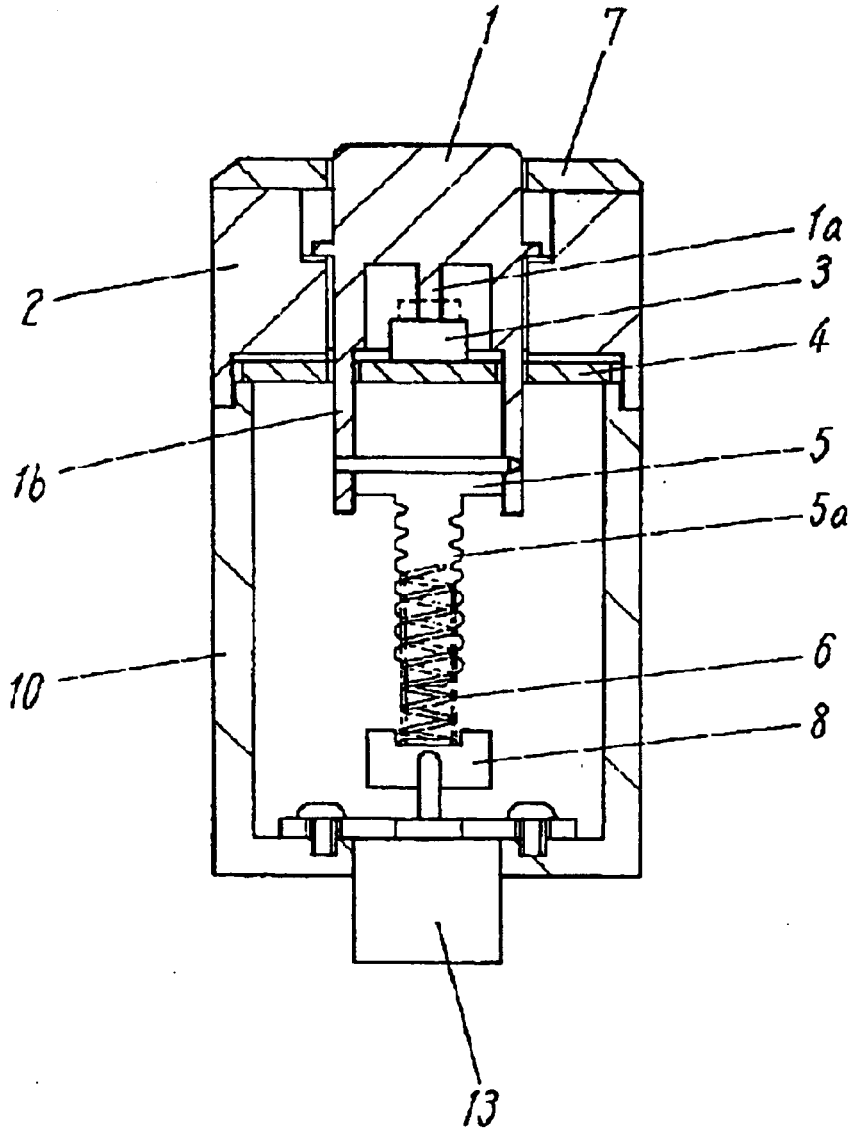
FIG. 3 is a cross-sectional view of an input device in accordance with Exemplary Embodiment 3 of the invention.

FIG. 3 is a cross-sectional view of an input device in accordance with Exemplary Embodiment 3 of the present invention. In FIG. 3, the same elements as those shown in FIG. 1 according to Embodiment 1 are denoted by the same reference numerals, are not described. Stepping motor 13 is driven by an external control circuit (not illustrated). When a predetermined number of pulses is supplied to stepping motor 13, the motor rotates according to the number of the pulses supplied. Therefore, a moving amount (a projecting amount) of button 1 can be arbitrarily controlled through an external open loop control with by stepping motor having a required number of pulses supplied thereto.

Exemplary Embodiment 4

Figure 4:
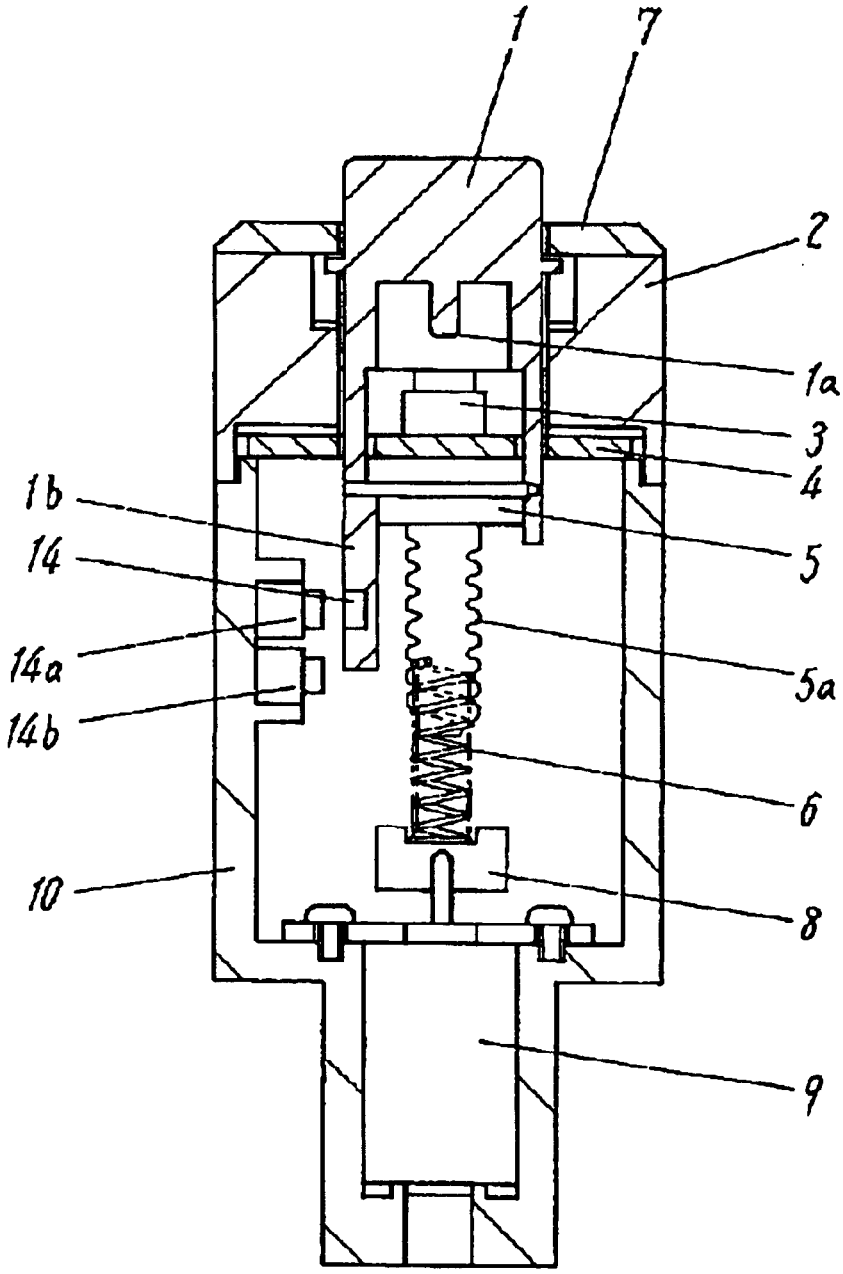
FIG. 4 is a cross-sectional view of an input device in accordance with Exemplary Embodiment 4 of the invention.

FIG. 4 is a cross-sectional view of an input device in accordance with Exemplary Embodiment 4 of the present invention. In FIG. 4, the same elements as those shown in FIG. 1 according to Embodiment 1 are denoted by the same reference numerals, are not described. Magnet 14 is attached to leg 1*b* of button 1 by a method such as of insertion molding and adhesion. Plural magnetic sensors 14*a* and 14*b* facing magnet 14 are placed on a wall of base 10. Magnetic sensor 14*a* is positioned for sensing a magnetic field of magnet 14 of button 1 in an ordinary state (projecting), and magnetic sensor 14*b* is positioned for sensing a magnetic field of magnet 14 of button 1 lowered.

In this input device, button 1 positioned at its highest position is sensed by magnetic sensor 14*a*, and button 1 positioned at its lowest position is sensed by magnetic sensor 14*b*. Therefore, even if motor 9 is an inexpensive DC motor, a highest limit and a lowest limit of button 1 is easily determined by feeding back a signal indicating that button 1 is positioned at its highest position and at its lowest position. Further, magnetic sensors 14*a* and 14*b* may generate signals used instead of switch 3, hence eliminating switch 3.

Exemplary Embodiment 5

Figure 5:
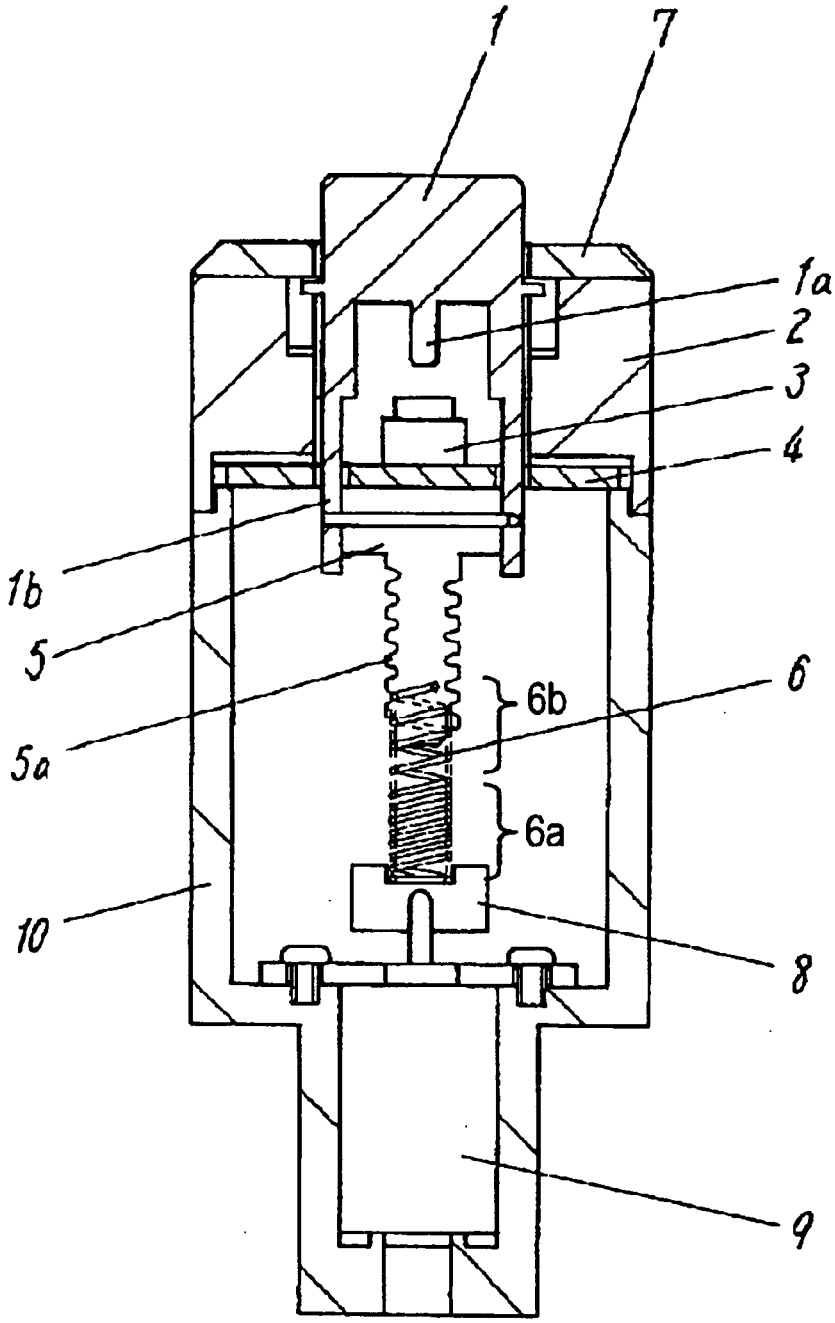
FIG. 5 is a cross-sectional view of an input device in accordance with Exemplary Embodiment 5 of the invention.

FIG. 5 is a cross-sectional view of an input device in accordance with Exemplary Embodiment 5 of the present invention. In FIG. 5, the same elements as those shown in FIG. 1 according to Embodiment 1 are denoted by the same reference numerals, are not described. Coil spring 6 has unequal-pitch portion 6*a* having a pitch different from a pitch of helical part 5*a*. A spring constant of portion 6*a* is set so that button 1 receives a resilient force suitable to activate switch 3. Portion 6*b* of the spring engaged onto helical part 5*a* of driving member 5 has a pitch equal to the pitch of helical part 5*a*. This arrangement provide the input device with button 1 having an appropriate handling force and moves in up and down directions.

Exemplary Embodiment 6

Figure 6:
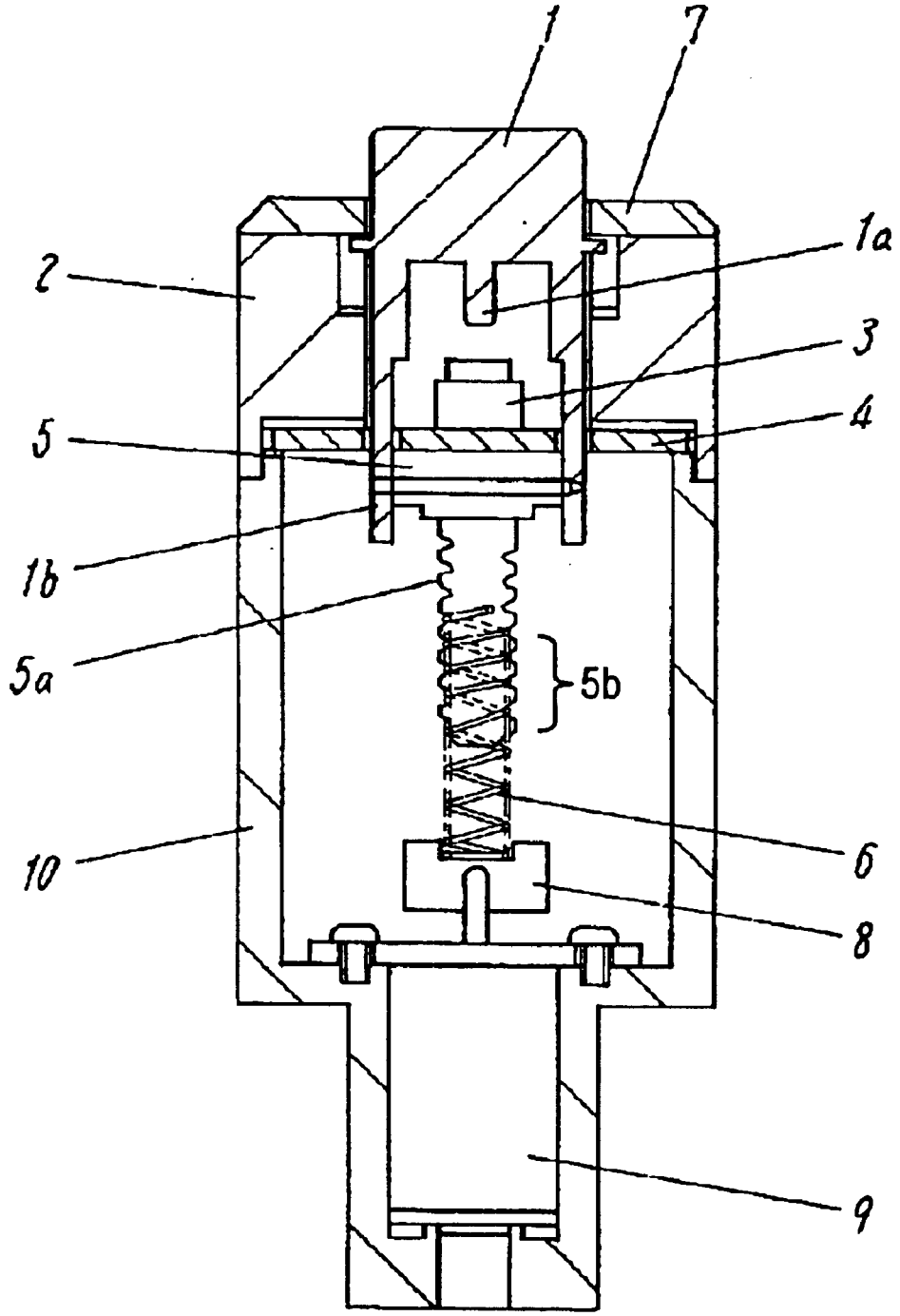
FIG. 6 is a cross-sectional view of an input device in accordance with Exemplary Embodiment 6 of the invention.

FIG. 6 is a cross-sectional view of an input device in accordance with a sixth exemplary embodiment of the present invention. In FIG. 6, the same elements as those shown in FIG. 1 according to Embodiment 1 are denoted by the same reference numerals, are not described. When coil spring 6 is wound to pull button 1 and allow the button to contact switch 3, coil spring 6 is elongated by a bouncing load of switch 3 and has its pitch widened. A pitch of tip portion 5*b* of helical part 5*a* of driving member 5 is equal to the widened pitch of coil spring 6. When coil spring 6 is not loaded by switch 3, namely, is not elongated, coil spring 6 is engaged onto helical part 5*a* while having the pitch widened by elasticity of the coil. When coil spring 6 is loaded by switch 3, coil spring 6 is engaged onto helical part 5*a* having the pitch identical to the widened pitch of the spring. This arrangement enables the spring to be smoothly wound, hence allowing button 1 to move.

Exemplary Embodiment 7

Figure 7:
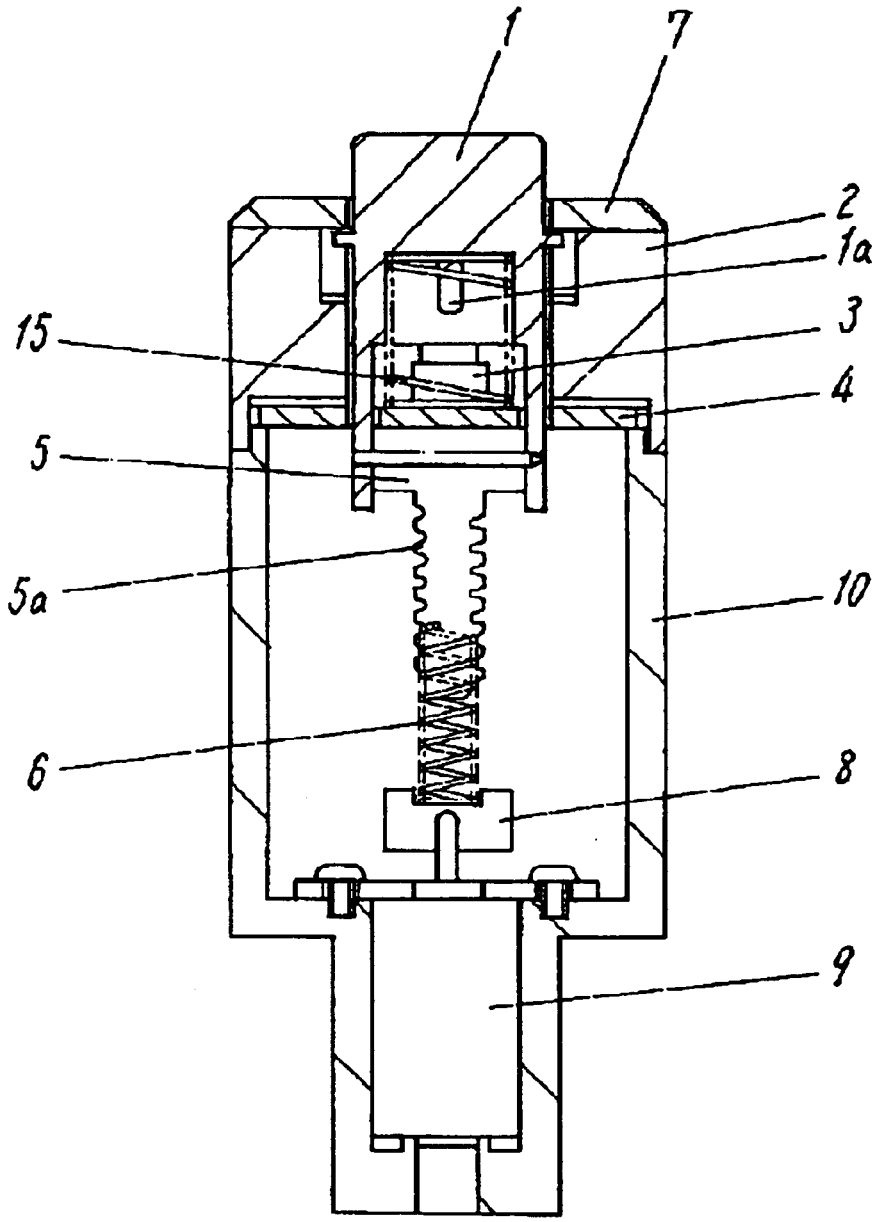
FIG. 7 is a cross-sectional view of an input device in accordance with Exemplary Embodiment 7 of the invention.

FIG. 7 is a cross-sectional view of an input device in accordance with Exemplary Embodiment 7 of the present invention. In FIG. 7, the same elements as those shown in FIG. 1 are denoted by the same reference numerals, are not described. The device includes adjustment coil spring 15 placed inside button 1 additionally to coil spring 6 engaged with helical part 5*a* of driving member 5 attached to button 1. Adjustment coil spring 15 pushes button 1 upward, away from printed board 4, namely, away from switch 3. Resilient force of adjustment coil spring 15 can be se to a level different from that of coil spring 6. An operating force of button 1 for activating switch 3 therefore can be arbitrarily controlled by appropriately controlling the resilient force of coil spring 15.

Exemplary Embodiment 8

Figure 8:
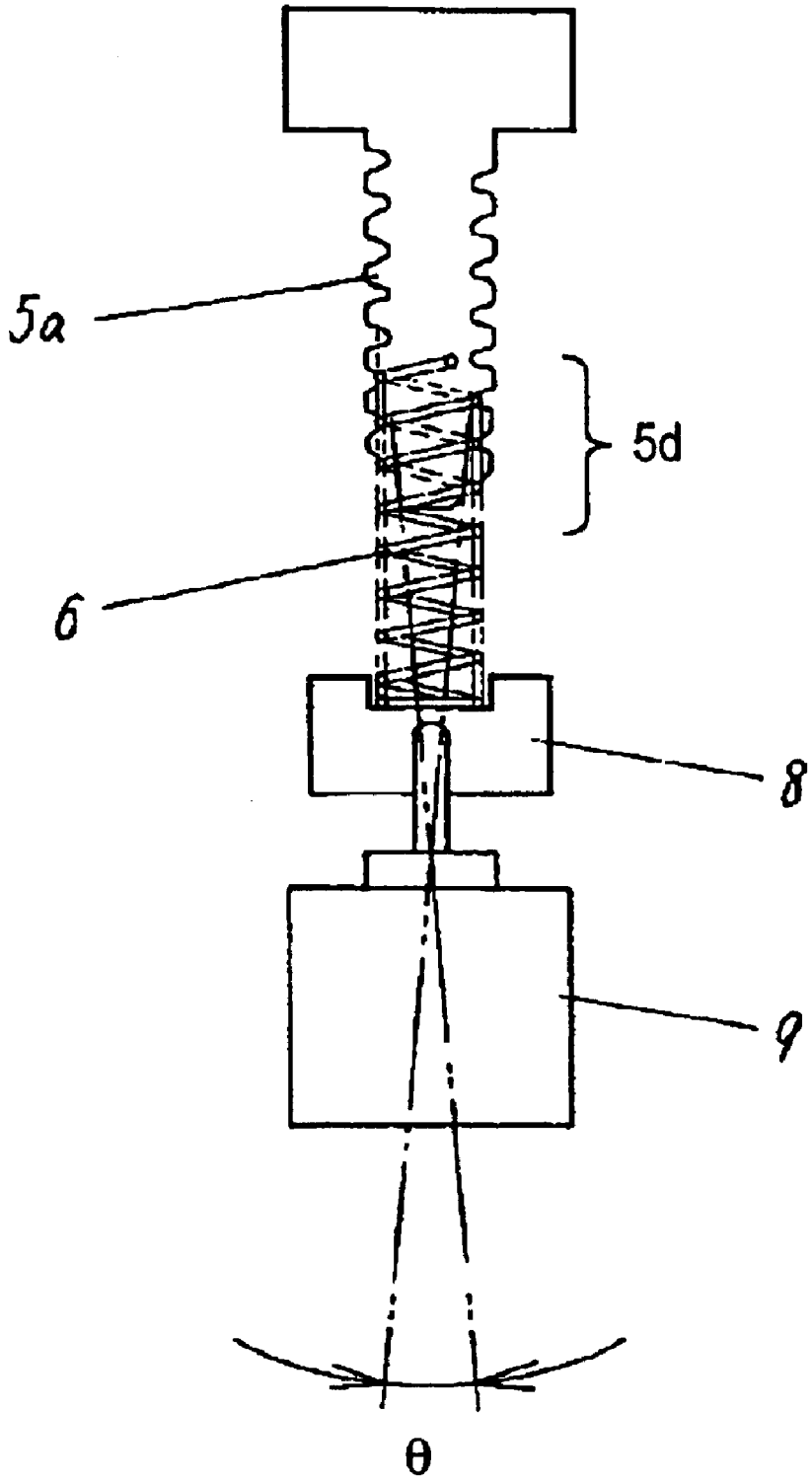
FIG. 8 is a cross-sectional view of an input device in accordance with Exemplary Embodiment 8 of the invention.

FIG. 8 is a cross-sectional view of an input device in accordance with an eighths exemplary embodiment of the present invention. In FIG. 8, the same elements as those shown in FIG. 1 are denoted by the same reference numerals, are not described. Tip portion 5*d* of helical part 5*a* of driving member 5 which is to have coil spring 6 wound around is tapered by an angle θ. Coil spring 6 is easily engaged with driving member 5 even if coil spring 6 and helical portion 5*a* are not coaxially lined up due to variation of dimensions of components, hence improving reliability of the input device.

Exemplary Embodiment 9

Figure 9:
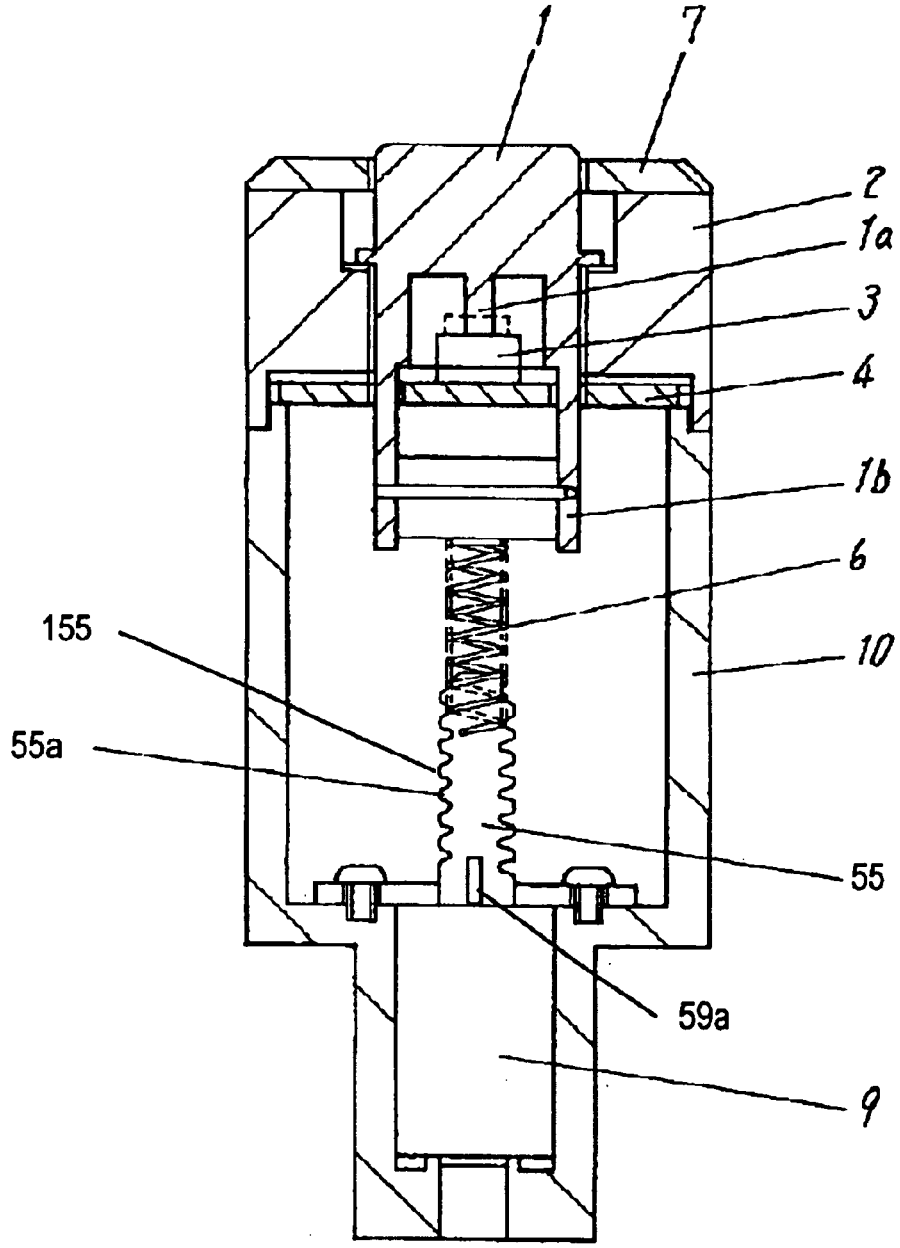
FIG. 9 is a cross-sectional view of an input device in accordance with Exemplary Embodiment 9 of the invention.
Figure 10:
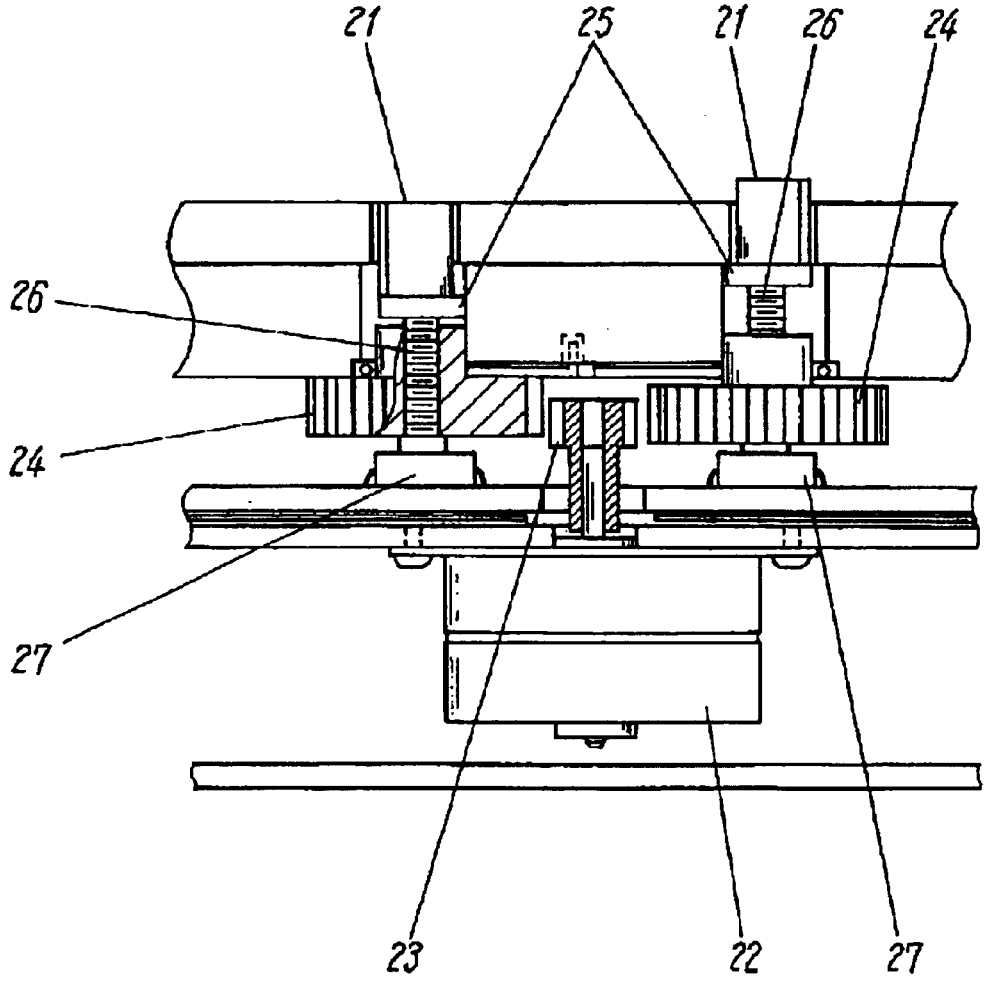
FIG. 10 is a cross-sectional view of a conventional input device.

FIG. 9 is a cross-sectional view of an input device in accordance with Exemplary Embodiment 9 of the present invention. In FIG. 9, the same elements as those shown in FIG. 1 according to Embodiment 1 are denoted by the same reference numerals, are not described. As shown in FIG. 9, driving member 55 is fixed to output shaft 59*a* of motor 9. Driving member 55 has helical part 55*a* having recess 155 formed spirally by a pitch substantially identical to a pitch of coil spring 6.

Coil spring 6 is fixed on a bottom of button 1 unitarily with button 1. The input device is identical to the device according to Embodiment 1 shown in FIG. 1, except for driving member 5 and coil spring 6 are placed in a reverse position with each other. In this input device, coil spring 6 is linked directly to driving member 55 fixed to output shaft 59*a* of motor 9 without an additional component. This arrangement reduces number of components of the input device and simplifies the device.

Components and mechanisms of devices according to Embodiments 1 to 8 can be used for the input device according to Embodiment 9.

INDUSTRIAL APPLICABILITY

In an input device according to the present invention, a button and a motor is linked by a coil spring. The button moves in up and down directions, and a switch is activated with a simple mechanism.

What is claimed is:

1. An input device comprising:

a button;

a case operable to guide the button for allowing the button to slide;

a switch fixed to the case and activated with the button;

a motor fixed to the case;

a driving member fixed to one of the button and the motor;

a coil spring fixed to other of the button and the motor, the coil spring being operable to be engaged with the driving member, the coil spring being operable to be rotated to move relatively to the driving member.

2. The input device according to claim 1, wherein the driving member has a helical part having a recess formed spirally, and wherein the coil spring is operable to be engaged with the helical part and be wound around the helical part.

3. The input device according to claim 2, wherein the coil spring has a portion having a pitch different from a pitch of another portion of the coil spring.

4. The input device according to claim 2, wherein the helical part of the driving member has a portion having a pitch different from a pitch of another portion of the helical part.

5. The input device according to claim 2, wherein the coil spring has a low-friction surface.

6. The input device according to claim 2, wherein the helical part has a low-friction surface.

7. The input device according to claim 2, wherein the helical part of the driving member is tapered at a tip of of the helical part.

8. The input device according to claim 1 further comprising an encoder detecting a rotation of the motor.

9. The input device according to claim 1, wherein the motor comprises a stepping motor.

10. The input device according to claim 1, further comprising a sensor for detecting a movement of the button.

11. The input device according to claim 1, further comprising a spring applying a force to urge the button.

* * * * *